United States Patent [19]

Koller et al.

[11] Patent Number: 4,860,516

[45] Date of Patent: Aug. 29, 1989

[54] PORTABLE CUSHIONED FLOOR SYSTEM

[76] Inventors: Gregory V. Koller, 1633A N. 24th St., Milwaukee, Wis. 53205; Harold A. Koller, R.R. #2, Box 83, Osceola, Wis. 54020

[21] Appl. No.: 144,509

[22] Filed: Jan. 15, 1988

[51] Int. Cl.[4] ..... E04B 5/52

[52] U.S. Cl. ..... 52/480; 52/508

[58] Field of Search ..... 52/508, 509, 403, 480, 52/126.6; 272/2, 3, 4, 109, 137; 404/35

[56] References Cited

U.S. PATENT DOCUMENTS

| | | | |
|---|---|---|---|
| 2,743,487 | 5/1956 | Kuhlman | 52/508 X |
| 2,823,427 | 2/1958 | Kuhlman | 52/480 |
| 3,271,916 | 9/1966 | Ornholt | 52/480 X |
| 4,325,546 | 4/1982 | McMahon et al. | 52/480 X |
| 4,443,989 | 4/1984 | Silvey et al. | 52/480 X |

OTHER PUBLICATIONS

Horner Hard Maple Flooring, Horner Flooring Co., 1987, pp. 6, 7 and 12.

Hard Maple & Rubber Sports Surfaces, Robbins, Inc., Cat #M100-78436.5M, 1985, pp. 8, 9, 14 and 15.

The Mark of a Champion Floor, Connor Forest Industries, pp. 4, 5 and 8.

*Primary Examiner*—Carl D. Friedman
*Assistant Examiner*—Creighton Smith
*Attorney, Agent, or Firm*—Andrus,Sceales,Starke&Sawall

[57] ABSTRACT

A portable cushioned floor system utilizes a modular construction in which each floor module is enclosed with a lower floor plate that protects the flexible resilient cushioning layer during transport and installation and after installation. The lower floor plate is attached to a floor-supporting upper plate with fasteners that maintain a maximum spacing yet permit full flexibility of the intermediate cushioning layer.

13 Claims, 2 Drawing Sheets

FIG. 1
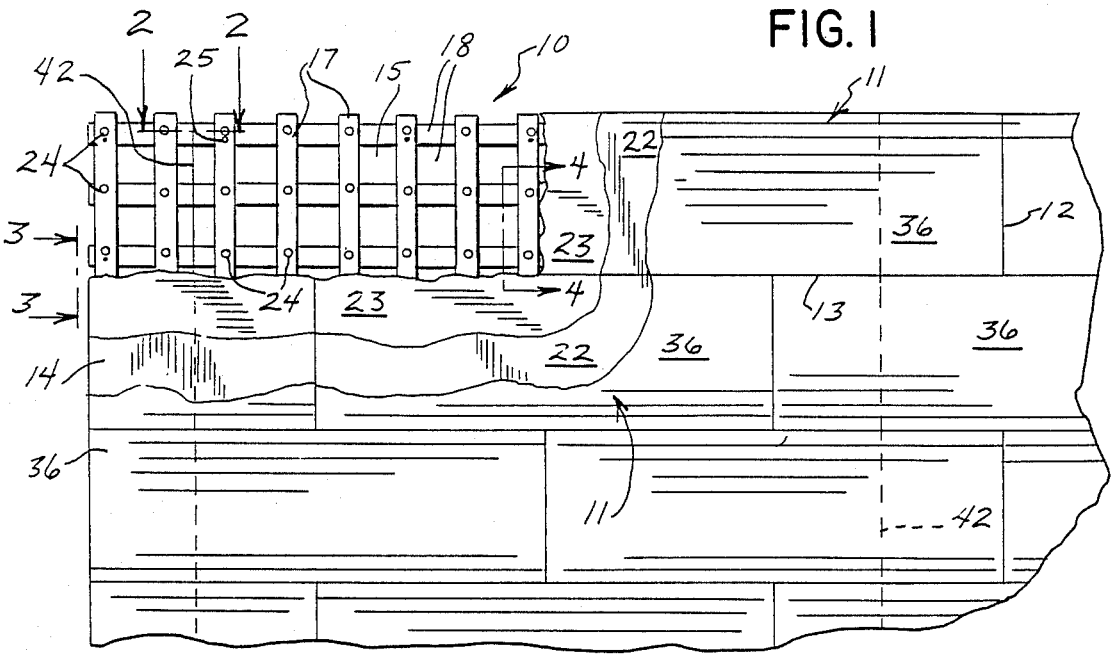
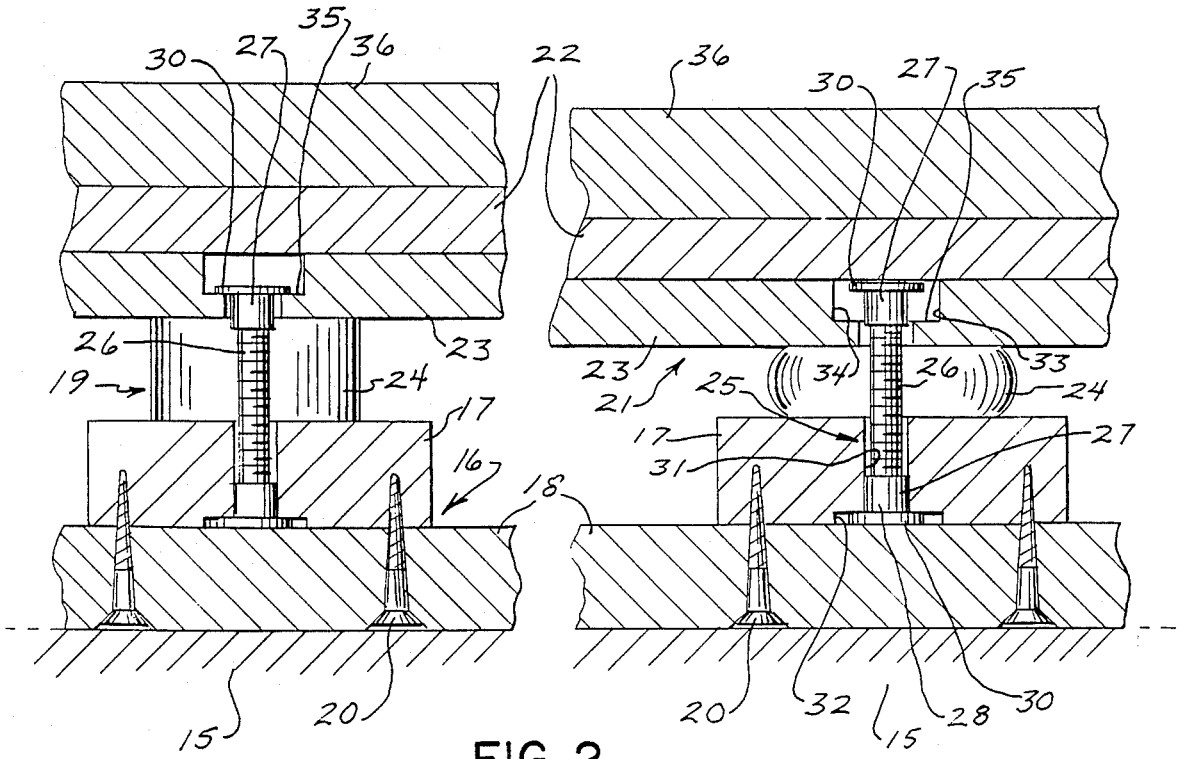
FIG. 2

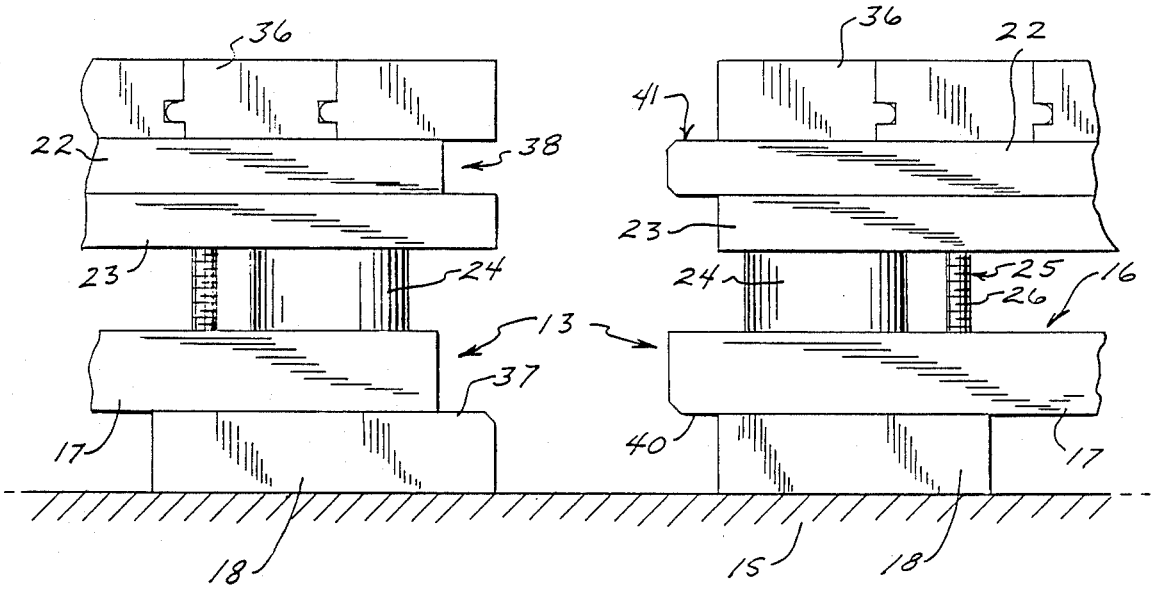
FIG. 3
FIG. 4
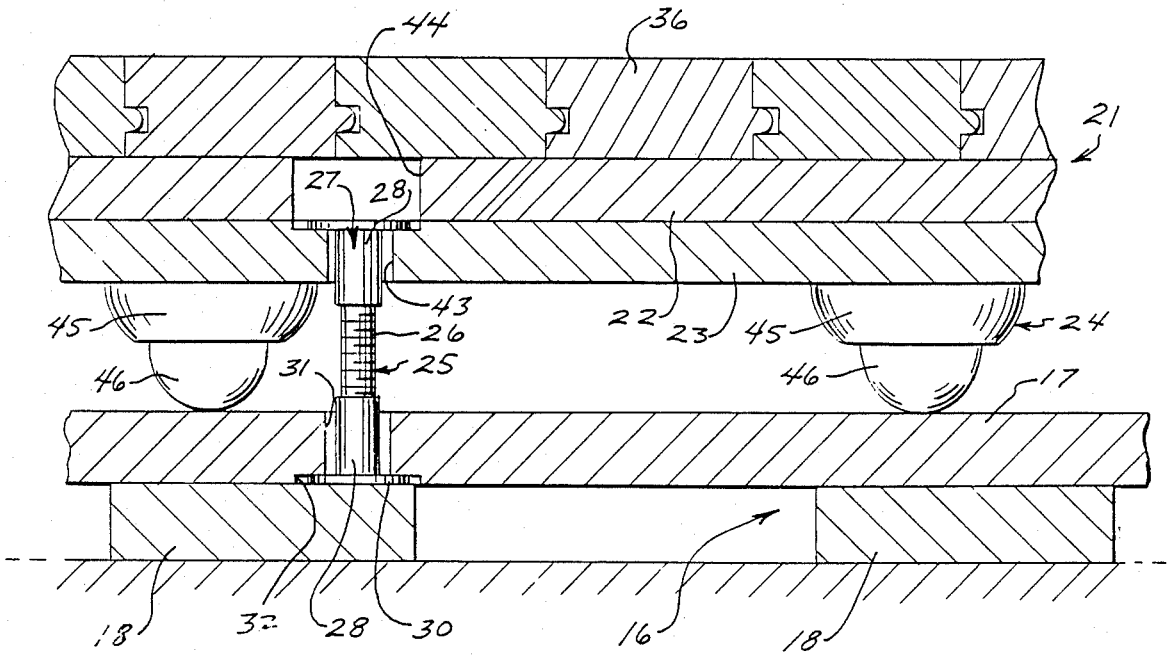

PORTABLE CUSHIONED FLOOR SYSTEM

BACKGROUND OF THE INVENTION

The present invention relates to floor systems for athletic use and, more particularly, to a cushioned floor system of modular construction which is completely portable.

Floor systems used in athletic, sport, and recreational facilities, such as gymnasiums, arenas, roller skating rinks, dance and exercise studios, and the like, often utilize hardwood flooring. Such flooring generally comprises long and relatively narrow hardwood boards, typically mounted in interlocking engagement with a conventional tongue and groove construction as is well known in the art. The hardwood surface flooring may be supported on a base surface, such as a concrete slab, in a variety of ways. However, the floor is typically categorized as either fixed or floating. As the terms imply, a "fixed" floor is attached directly to the base concrete slab with an intermediate supporting layer or layers, and a "floating" floor lies on the base slab, separated by intermediate layers of various materials, but without direct attachment to the slab.

Floating floor systems, in particular, are often constructed with resilient intermediate layers which result in a cushioned floor system providing varying degrees of surface flexibility. It is well known that cushioned floor systems provide substantial benefits to users of sport and recreational facilities utilizing such floors. Resilient or cushioned floors which help absorb the shock to the user resulting from vertical impacts by the user on the floor, not only reduce fatigue and the chance of injury, but provide a vertical spring-back which may enhance athletic performance.

Thus, cushioned floor systems providing some degree of vertical flexibility have been proposed in a variety of constructions utilizing both conventional hardwood top flooring and a variety of other surface materials. However, high quality hardwood flooring must be carefully installed and maintained and properly cushioned to maintain its quality and performance. By comparison, other athletic surfaces are not generally as sensitive to the type and quality of subflooring materials, including resilient cushioning devices.

It is also known to make athletic and recreational floors of a modular construction in which prefabricated modules are laid side by side on a supporting base and interconnected to form a continuous floor surface. Modularity not only facilitates initial installation, but in some cases may be desirable to allow the floor to be subsequently disassembled and removed, to, for example, provide for installation of a different surface or to adapt the facility to another use. However, modularity in flexible cushioned floor systems requires more care in protecting the flexible cushioning means which are, in general, more susceptible to damage than the harder and more rigid wood or wood-base components. In addition, modular constructions utilizing quality hardwood floor surfaces must also be carefully constructed so the inherent additional handling is not detrimental to the integrity of the floor surface.

In U.S. Pat. No. 4,648,592 (Harinishi), there is disclosed a modular cushioned athletic floor. Each module comprises a unitary panel board piece having resilient compressible foam supporting members attached to the underside to rest directly on the underlying base surface (e.g. concrete slab). The modules are interconnected with special edge connectors and a continuous top playing surface comprising a composite of foam supported carpet is laid over the modules. As a result of either installing or dismantling the floor system, the relatively delicate foam supporting members, which are preferably made of ethylene vinyl acetate foam and bear directly on the base surface, are readily susceptible to damage. Positioning the modules may result in lateral movement which can scuff and damage the compressible foam supports or tear them from their attachment to the panelboard module. The compressible supporting members are also relatively unprotected against dirt, moisture and the like which may be present on the concrete base surface.

U.S. Pat. No. 3,604,173 (Dahlborg) discloses a resilient athletic floor, also of the floating type, in which two separate layers of compressible resilient pads are attached to opposite sides of an intermediate floor panel of particle board or plywood with the lower layer of resilient pads lying on the base surface and the upper layer supporting another fiber or particle board layer covered with a surface of linoleum mat, vinyl tiles, or the like. The floor is not modular and is intended for permanent installation. Nevertheless, the lower layer of resilient pads which bears directly on the supporting base slab is unprotected, either from potential damage during installation or environmental conditions encountered thereafter.

In U.S. Pat. No. 2,862,255 (Nelson), a conventional tongue and groove hardwood floor construction is disclosed utilizing typical wooden sleepers to support the flooring, but providing a cushioned, floating installation by attaching flexible cushions in a spaced orientation to the undersides of the sleepers. The flexible cushions, which are made of rubber or another suitable elastomer, bear directly on the concrete slab or other base surface. Although the floor system described in this patent is intended for permanent installation, the resilient supporting cushions are directly exposed and relatively unprotected.

U.S. Pat. No. 4,325,546 (McMahon et al) discloses an athletic floor module comprising upper and lower floor plates of wood or other stiffly resilient material which are held in spaced parallel relation by a small rigid spacer attached to both plates and disposed generally in the center of the plate areas. Compressible resilient members are disposed between the plates, generally along the periphery and in a symmetrical pattern around the center spacer. The module is supported above the underlying base surface by a rigid peripheral frame. Live loads on the central portion of the module cause concurrent vertical deflection of the interconnected upper and lower plates, while loads applied further from the center and toward the peripheral edges cause compression of the resilient members and vertical deflection of the upper plate toward the lower plate. Proper choice of plate, spacer, and resilient materials, and their sizing, orientation and spacing, is intended to provide a floor module with uniform vertical deflection over the entire upper plate surface. As an integral part of the foregoing construction, hold down bolts extending between the plates are used to prevent upward movement of one peripheral edge of the upper plate as a result of a downward impact force on an opposite peripheral edge, yet permit vertical deflection of the upper plate as indicated above.

The module disclosed in McMahon et al and a floor constructed of such modules inherently requires two modes of flexibility for proper function, i.e. a simultaneous bending of both spacer-connected plates and a separate deflection of the upper plate toward the lower. Uniformity of deflection requires careful choice and balancing of the material types, and sizing, orientation and spacing of the various components. The construction of the module of the preferred embodiment includes an upper plate of plywood covered by a thin polyurethane layer and is particularly intended for use as a running track, although other athletic applications are also suggested. Although such an upper surface may be suitable for a flexible floor system utilizing the bimodal flexibility described above, such a system is not considered suitable for use with conventional hardwood flooring.

U.S. Pat. No. 3,422,732 (York) shows a flexible artificial ski mat having sheet-like upper and lower surfaces of flexible rubber separated by a layer of resilient compressible foam. The upper surface is intended to deflect toward the lower under live load and anti-friction supporting elements on the top surface are, in one embodiment, attached with bolts recessed and anchored in the foam layer to accommodate vertical movement of the upper surface toward the lower. In that construction, however, the bolts merely hold the anti-friction elements in place and do not restrict relative movement between the upper and lower surfaces or provide any resistance to horizontal displacement as a result of lateral shear forces.

A relatively recent development in floating cushioned floor systems utilizes small elastomer pads which are uniformly distributed in spaced relation across the underside of the floor to support it above the underlying base surface. The elastomer pads provide two stages of compressibility, one to carry the dead weight of the floor and light live loads as are imposed by walking, and the other to absorb heavier shock loads resulting from running, jumping or falling. This floor system is sold under the trademark "NEO-SHOK" by Conner Forest Industries. However, such floor systems do not utilize a modular construction and have been limited to relatively large permanent installations. The shock absorbing elastomer pads must be fastened to the underside of the floor, typically by gluing or stapling. With either method of attachment, it is generally known that the elastomer pads are not tolerant to horizontal shear loads and, as a result, movement of floor panels and attached pads across the subfloor may result in damage or displacement of the elastomer pads. Thus, the floor system does not inherently lend itself to portability even though a portable cushioned athletic floor has potentially broad applicability and use. For example, a portable floor which has an attractive, durable and functional surface and which uses modules that are easy to assemble and disassemble could be used in aerobic exercise and dance facilities, athletic shoe stores, and similar installations where floors of relatively small area are typical. True portability would also allow such a floor to be moved from one location to another and to be maintained as personal property. In particular, portable floor systems utilizing high quality hardwood flooring would be particularly attractive for many such applications. However, where elastomer cushions and shock absorbing pads are used, the pads must also be protected against dirt, moisture and other contaminants, as well as scuffing, tearing or displacement as a result of lateral shear loads. Such hazards are especially acute where the added movement and handling of a portable floor are present.

SUMMARY OF THE INVENTION

In accordance with the present invention, a portable cushioned floor module includes upper and lower plate means which enclose and protect flexible resilient cushioning means disposed in between. The cushioning means preferably comprises a series of shock absorbing elastomer pads uniformly distributed between the opposed surfaces of the upper and lower plate means, but a continuous layer of resilient padding may also be used. The lower plate is adapted to rest on the underlying base floor and to support the resilient pads and upper plate means. Fasteners connect the upper and lower plate means in a manner to prevent relative horizontal movement between them and, as a result, the resilient pads are not exposed to any damaging horizontal shear loads. The fasteners are further adapted to hold the resilient pads firmly between the upper and lower plate means when the pads are substantially uncompressed, but to allow the upper plate means to move toward the lower as a result of vertical compression of the pads under live floor loads.

The interplate fasteners preferably comprise bolts having one end fixed to one of the plate means and the other end attached, as with a nut, to the other plate means, such that the plates may move toward one another, as indicated above, but are restrained from movement away from one another to a distance greater than the thickness of the resilient pads. Each module of the present floor system functions in the same manner as a conventional permanent floating floor utilizing resilient cushions, but is fully portable and can be moved readily over the base surface, or otherwise transported and handled, without any exposure of the resilient pads to potentially damaging horizontal shear loads. In addition, the pads are virtually encapsulated and, when in place, are maintained above the base surface and protected from dirt, moisture and other contaminants.

The portable cushioned floor module of the present invention may be used with a variety of floor surfaces, but is particularly adapted for use with a high quality hardwood flooring surface. Such a flooring surface, typically comprising narrow strips of hardwood having a tongue and groove construction, requires a firm supporting base. In a preferred embodiment of the invention, the portable module includes an upper plate and surface and resilient elastomer pads utilized in a conventional floating cushioned hardwood floor, with the unique addition of an encapsulating lower plate which protects the pads while retaining full cushioning functionality.

BRIEF DESCRIPTION OF THE DRAWINGS

FIG. 1 is a top plan view of a portion of a portable cushioned floor system utilizing the modules of the present invention with portions thereof broken away to show the internal construction.

FIG. 2 is a vertical section through a module taken on line 2—2 of FIG. 1.

FIG. 3 is a vertical section through two adjacent modules, taken on line 3—3 of FIG. 1, with the modules separated horizontally to show the construction of the intermodule connection.

FIG. 4 is a vertical section taken on (line 4—4 of FIG. 1) showing a module construction utilizing a preferred embodiment of the resilient shock absorbing pads.

DETAILED DESCRIPTION OF THE PREFERRED EMBODIMENT

A portable cushioned floor system 10 is assembled from an array of individual modules 11. Each module 11 is preferably constructed of a size which may be conveniently handled by one person in the process of assembling or disassembling the floor system 10. Thus, each module may have a nominal size of two feet by six feet in plan. As assembled in the floor system, the modules are preferably arranged such that there is a direct abutment and match along adjacent narrow sides 12 and a staggered and overlapping abutment between modules along their long sides 13. Although such a staggered arrangement is not absolutely necessary, it adds stability to the interconnected floor system. However, the staggered arrangement requires the use of half-size modules 14 in alternate rows at the ends of the floor, as shown.

Each of the modules and the floor system assembled therefrom are laid directly on a base surface 15, such as a concrete slab. Each module includes a composite lower plate 16 which is constructed to provide uniform support for the module over its entire surface area. The composite construction of the lower plate 16 preferably comprises an interconnected gridwork of lateral slats 17 and longitudinal slats 18 lying in vertically displaced horizontal layers. In the embodiment shown, the longitudinal slats 18 form the lower layer in contact with the base surface 15 and the lateral slats 17 lie atop the longitudinal slats and are disposed perpendicularly thereto.

The slats may conveniently be made of wooden 1×3's with the slats of each layer lying in spaced, parallel relation with the spacing selected to accommodate placement of other module elements, as will be described hereinafter.

The open gridwork of slats 16 and 17 provides the necessary structural rigidity for the lower plate 16 while minimizing the weight. The slats may be interconnected where they cross by means of nails or screws 20 as shown. Alternately, the slats may utilize a dadoed construction in which one or both of the interconnected members is provided with a groove to accommodate receipt therein of the other slat. Such construction would enhance lateral stability, but would be more expensive.

The module also includes an upper plate 21 which is also preferably of composite construction. The composite upper plate, thus, comprises two continuous layers, an upper layer 22 and a lower layer 23. Each of the layers 22 and 23 is preferably made of oriented strand board of a type typically used in floating cushioned athletic floor systems. Each of the layers may additionally be of the same thickness, but the relative thicknesses of the two layers 22 and 23 of the upper plate are not critical to the present invention.

An intermediate cushioning layer 19 comprising a series of flexible resilient shock absorbing pads 24 is interposed between and separates the lower plate 16 and the upper plate 21. The pads may be of any of the types used in conventional cushioned floating floor systems. Thus, they may be constructed of rubber or any of many suitable synthetic elastomers, such as urethane or neoprene. In addition, the size and flexibililty or durometer of the pads may vary widely depending on the primary intended use for the floor. Likewise, the spacing between the pads may be varied substantially, depending again on the nature of the desired cushioning effect. It is important, however, that the resilient pads 24 be substantially equally distributed across the opposing surface areas of the lower and upper plates 16 and 21 to assure uniformity in cushioning and vertical deflection under live loading conditions. A continuous uniform layer of resilient padding material, such as a closed cell polyurethane foam, may also be used.

The pads 24 may be attached to either the upper plate or the lower plate by any convenient means, such as gluing, stapling, or the like. In the embodiment shown and referring particularly to FIG. 1, the resilient pads are located on the surface of the lateral slats 17 in the areas vertically above each intersection or crossing point of a lateral slat with an underlying longitudinal slat 18. In this manner, any vertical load imposed on the resilient pads through the overlying upper plate 21 will be absorbed by the pads and transmitted vertically downward to the base surface 15 without any intermediate deflection of the lower plate 16 (or either layer of slats 17 or 18 of which it is comprised). Because it is preferable, as indicated above, to have the pads uniformily distributed over the entire module area, the gridwork of slats 17 and 18 may conveniently be laid out with equal lateral and longitudinal spacing between the slats to provide the desired equal and uniform pad spacing or convenient multiples thereof. If the layout of the gridwork of slats is utilized to establish the spacing of the resilient pads, the pads may more conveniently be attached to the lower plate 16, rather than the underside of the upper plate 21, to eliminate the necessity of having to separately layout a pad spacing on the underside of the upper plate.

To lend true portability to the module 11 the lower plate 16 must be attached to the upper plate 21 with the resilient pads 24 firmly sandwiched therebetween. By enclosing and essentially encapsulating the resilient pads, the pads are held firmly in place and protected against potentially damaging contact, either as a result of inadvertant forces or loads or from contaminants. It is well known that many elastomers cannot be easily glued to the surface and, if the pads in the module were not protected by the underlying lower plate, movement of the module over the base surface would easily displace and/or damage the pads. In addition, however, the lower plate must be attached to the upper plate in a manner which will prevent relative horizontal movement between the plates and yet allow vertical downward movement of the upper plate toward the lower plate as the pads are vertically compressed under live floor loads. Finally, the interconnection of the upper and lower plates should hold the pads snugly therebetween when the pads are substantially uncompressed to prevent vertical movement between the plates to a distance greater than the thickness of the pads. This latter feature provides an integrity to the module which enhances its portability by eliminating unnecessary movement between the plates and the possible loss of loose resilient pads.

The desired interplate connection having the foregoing necessary and desirable features is provided by a series of bolted connections 25. Each of the bolted connections could comprise a more or less conventional bolt and nut, but will be described with respect to a preferred construction of less conventional design. Each bolted connection 25 includes a threaded stud 26 having an essentially identical threaded nut 27 attached to each end. The nut 27 includes a cylindrical body 28 and an integral disc-like flange 30. The lower one of the threaded nuts 27 is positioned within a through bore 31 in a lateral slat 17, preferably closely adjacent to a resilient pad 24. The lower end of the through bore 31 may be provided with a shallow counterbore 32 to accommodate the flange 30 of the nut, such that the nut is captured within the counterbore when the lateral and longitudinal slats are connected. The stud 26 is threaded into the captive lower nut 27 and locked therein either by bottoming out or with the use of a thread locking compound or device. The lower layer 23 of the upper plate 21 is also provided with a through bore 33 having a diameter slightly larger than the diameter of the body 28 of the nut. The upper portion of through bore 33 is provided with a deep counterbore 34 having a diameter greater than the diameter of the nut flange 30.

Referring to the lefthand side of FIG. 2, showing the lower module in an essentially unloaded state, the length of the threaded stud 26 is such that it extends approximately to the bottom of counterbore 34 such that the upper nut 27 may be threaded downwardly onto the stud until the integral flange 30 engages a shoulder 35 defining the bottom of the counterbore 34. The nut is drawn up, as with a screwdriver or similar tool (not shown) engaging a suitable recess in the flanged head of the nut, so that the upper and lower plates 21 and 16 are drawn firmly against the faces of the pad 24, but without substantially compressing it.

Referring now to the right hand side of FIG. 2, the imposition of a vertical live load on the floor surface results in compression of the underlying resilient pad or pads and corresponding downward vertical movement of the upper plate toward the lower plate. To accommodate the vertical downward movement of the upper plate, there is sufficient vertical clearance in the counterbore 34 above the stud 26 and attached upper nut 27. The counterbore must have a depth sufficient to accommodate downward movement of the upper plate 21 at least equal to the maximum vertical deformation of the pad expected under live floor load design conditions without the nut engaging the underside of the upper layer 22.

Most conveniently, a bolted connection 25 is made adjacent to a resilient pad 24 and within the plan area of overlap at the intersection of a lateral slat 17 and a longitudinal slat 18. However, it is generally not necessary to provide a bolted connection for each resilient pad 24 and, indeed, substantially fewer bolted connections are normally required for a single module in order to provide the firm interplate connection previously described. For example, in the nominal 2 ft. by 6 ft. module shown in FIG. 1, a total of 6 bolted connections will normally be sufficient. These will include one in each of the four corners and one midway along each of the two opposite long sides 13 of the module. In any case and depending on the type and weight of the materials used in constructing the module, the fasteners connecting the pads must be adequate to hold the module together and resist the anticipated horizontal shear loads.

The upper floor surface 36 preferably comprises high quality hardwood flooring of a conventional tongue and groove construction. The hardwood floor surface 36 is attached to the oriented strand board comprising the upper layer 22 by nails, clips, or other conventional fasteners (not shown) as is well known in the art. Although the portable floor modules of the present invention have particular utility when used as relatively small dance or aerobic exercise floors in which a hardwood upper floor surface is particularly desireable, virtually any type of flooring material may be used for the upper floor surface 36. It is even possible to eliminate the upper layer 22 of the upper plate 21 and lay the upper floor surface directly on the lower layer 23.

The modules 11 are joined to form the floor system 10 by staggering the edges of the various components of the upper and lower plates to form a tongue and groove interlock. Thus, referring particularly to FIG. 3, one of the long sides 13 of the module is formed with the lower longitudinal slat 18 offset laterally outward from the ends of the lateral slats 17 attached thereto to form a step 37. Similarly, the lower layer 23 and the upper floor surface 36 are offset laterally outwardly from the upper layer 22 to form a longitudinal groove 38. The opposite long side 13 of the module or, as shown in FIG. 3, the adjacent long side of the adjoining module, has the edges of the components of its lower and upper plates oppositely formed. Thus, the lower longitudinal slat 18 is offset laterally inwardly with respect to the overlying lateral slats 17 to form an inverted step 40. Correspondingly, the upper layer 22 of the upper plate extends laterally outwardly from the lower layer 23 and the upper floor surface 36 to form a longitudinal tongue 41. As the adjacent modules are moved into abutment along their long sides 13, the inverted step 40 and tongue 41 engage the step 37 and groove 38, respectively, to create a close-fitting joint which is particularly effective in maintaining the upper floor surfaces 36 of adjoining interconnected modules in a coplanar relationship. The short sides 12 of the modules are similarly formed to provide a like intermodule connection. In many cases, this intermodule tongue and groove connection will be sufficient to maintain a typical floor system together without any supplemental connections. In some cases, however, it may be desirable to utilize tie cables 42 (see FIG. 1) to tie the floor system securely together and prevent inadvertant displacement of the modules, particularly those located on the outer edges of the floor. The tie cables 42 may each comprise any convenient and suitable arrangement but, most preferably, the opposite ends of the cable are attached to the outer edges of the outermost longitudinal slats 18 with the cable extending over the longitudinal slats 18 of all adjoining modules. The cable then extends parallel to and in the space between the lateral slats 17. Any of several common and well-known devices may be utilized to impart a tension in the tie cable, such as a toggle connection or an overcenter latch.

A slightly modified construction of a portable floor module is shown in FIG. 4. Most of the components of this module are identical to those described in the embodiment shown in FIGS. 1 through 3 and are similarly identified. Referring particularly to the bolted connection 25, the lower layer 23 of the upper plate 21 has a small diameter through bore 43 to loosely receive the body portion 28 of the nut 27. The flange 30 of the nut 27 may bear directly on the upper surface of the lower layer 23 around the periphery of the through bore 43. To accommodate downward vertical movement of the upper plate with respect to the lower plate and the bolted connection 25, the upper layer 22 has a large diameter through bore 44 in axial alignment with the small diameter through bore 43 and the stud 26. Downward movement of the upper plate as a result of compression of the resilient pads 24 allows the upper portion of the bolted connection 25 to be received into the large diameter through bore 44. The thickness of the upper layer 22 (and depth of the through bore 44) must be at least equal to the total deflection of the resilient pads under maximum design load compression.

The resilient pads 24 shown in the FIG. 4 embodiment are of the type utilized in the permanent floating floor system sold under the trademark "NEO-SHOK", identified above. Each pad comprises a relatively flat circular base portion 45 and a smaller integral concentric semi-spherical protuberance 46. The small diameter protuberance 46 is intended to absorb and deflect initially under lighter live loads, while the larger base 45 is intended to absorb heavier shock and other high live floor loads. The spacing and attachment of these resilient pads may otherwise be chosen and made based on the same considerations used in the embodiment first described.

The enclosing lower plate 16 may be modified to provide more complete encapsulation of the intermediate layer 19 of resilient pads 24 or other cushioning material. For example, a continuous layer of a thin sheet material such as polyethylene may be laid between the upper and lower layers of slats 17 and 18 in the lower plate. This additional layer would add little to the cost and virtually nothing to the weight of the module 11, but would provide added protection against moisture, dirt and other contaminants from below.

The lower plate 16 may also be modified by substituting a continuous layer for the upper lateral slats 17. In this case, however, it is also preferable to substitute lateral slats for the lower longitudinal slats 18 shown. If a continuous layer comprising, for example, oriented strand board is substituted for the upper slats 17, it is particularly important to have a lateral orientation for the lower slats 18. Such orientation will provide added lateral tensile strength to help resist possible expansion of the hardwood upper floor surface 36, the grain of which runs longitudinally of the module and any expansion thereof would be perpendicular to the grain in a laterally horizontal direction. This modified lower plate would be particularly useful in a module using a continuous layer of cushioning material.

The present invention provides the capability of having true portability in a floating cushioned floor system previously relegated solely to essentially permanent installations. The modules may be constructed of a size and utilizing materials which enable one or two persons to carry, maneuver and place a module and install an entire portable floor system.

Various modes of carrying out the invention are contemplated as being within the scope of the following claims particularly pointing out and distinctly claiming the subject matter which is regarded as the invention.

We claim:

1. A portable cushioned floor module comprising:

(a) rigid upper plate means including a hardwood floor surface;

(b) lower plate means substantially coextensive with and disposed in parallel spaced relation to the upper plate means for rigidly supporting the module directly on a base surface;

(c) flexible resilient cushioning means disposed between and in abutting relation to the opposed surfaces of the plate;

(d) said cushioning means being substantially uniformly distributed across the opposed surface areas of the plate means;

(e) fastening means interconnecting the upper plate means and the lower plate means to prevent relative horizontal movement between said plate means; and, (f) said fastening means further adapted to allow vertical downward movement of the upper plate means in response to vertical compression of the cushioning means under live floor load.

2. The floor module as set forth in claim 1 wherein said fastening means is adapted to prevent relative vertical movement between the plates to a distance greater than the thickness of the cushioning means.

3. The floor module as set forth in claim 2 wherein the cushioning means comprises a series of elastomer pads.

4. The floor module as set forth in claim 3 wherein the pads are attached to the underside of the upper plate means.

5. The floor module set forth in claim 3 wherein said fastening means comprises a plurality of bolts, each bolt fixed by one end to one of the plate means and attached by its other end to the other of the plates means for relative vertical movement with respect thereto.

6. The floor module as set forth in claim 5 wherein each bolt is fixed to the lower plate means.

7. The floor module as set forth in claim 6 wherein the upper plate means comprises two layers of subflooring material.

8. The floor module as set forth in claim 7 wherein the lower plate means comprises an open gridwork of slats disposed in two horizontal layers with the slats of the layers lying substantially at right angles to one another.

9. The floor module as set forth in claim 8 wherein the pads are attached to the underside of the upper plate means and bear upon the upper surface of the upper layer of slats.

10. The floor module as set forth in claim 6 including recessed portions in the upper plate means for receipt of the other ends of the bolts, and a nut disposed in each recessed portion in the engagement with the bolt end therein and movable therewith relative to the upper plate means.

11. A portable cushioned floor system including a plurality of adjoining interconnected modules, each module comprising:

(a) a lower base plate for rigidly supporting the module directly on a base surface;

(b) a rigid floor plate coextensive with and disposed in parallel spaced relation to the lower plate including a hardwood floor surface;

(c) flexible resilient shock absorbing pads substantially uniformly distributed between the base plate and the floor plate maintaining the plates in parallel spaced relation;

(d) a plurality of fasteners extending between the base plate and the floor plate adapted to hold the pads firmly therebetween and to prevent relative horizontal movement between the plates and the pads; and, (e) said fasteners further adapted to allow relative vertical movement between the plates resulting from compression of the pads under live load.

12. The floor system as set forth in claim 11 wherein said floor system comprises a hardwood strip surface attached to the upper floor plate.

13. The floor system as set forth in claim 11 wherein the resilient pads each comprises a relatively flat circular base portion and an integral concentric circular protuberance having a diameter substantially smaller than the base portion.

* * * * *